166-250 SR
FTP8011 OR 3,960,212

United States Patent [19]

Hutchison

[11] 3,960,212

[45] June 1, 1976

[54] METHOD OF OBTAINING IMPRESSION INFORMATION FROM A WELL

[75] Inventor: Stanley O. Hutchison, Bakersfield, Calif.

[73] Assignee: Chevron Research Company, San Francisco, Calif.

[22] Filed: May 8, 1975

[21] Appl. No.: 575,751

Related U.S. Application Data

[62] Division of Ser. No. 510,265, Sept. 30, 1974.

[52] U.S. Cl. ..... 166/250; 166/64; 166/113; 166/187; 73/151

[51] Int. Cl.[2] ..... E21B 47/00; E21B 47/10

[58] Field of Search ..... 166/250, 187, 113, 64, 166/254, 255; 33/302; 18/5, 6; 73/151; 264/299

[56] References Cited

UNITED STATES PATENTS

| | | | |
|---|---|---|---|
| 2,416,441 | 2/1947 | Grant et al. | 73/151 |
| 2,653,474 | 9/1953 | Santiago | 73/151 |
| 3,046,601 | 7/1962 | Hubbert et al. | 166/250 X |
| 3,049,752 | 8/1962 | Jorda et al. | 73/151 X |
| 3,364,993 | 1/1968 | Skipper | 166/250 |
| 3,855,854 | 12/1974 | Hutchison et al. | 73/151 |
| 3,855,855 | 12/1974 | Hutchison et al. | 73/151 |
| 3,855,856 | 12/1974 | Hutchison et al. | 73/151 |

*Primary Examiner*—Stephen J. Novosad
*Attorney, Agent, or Firm*—R. F. Freeland, Jr.; Edward J. Keeling

[57] ABSTRACT

A self-contained wire line inflatable packer useful to carry an impression sleeve into a well for making impressions of the well surface, the inflatable sleeve of the wire line packer being automatically sequentially inflated and deflated by a valve controlled by a sequencing timer actuating means.

1 Claim, 19 Drawing Figures

161
159
155
24
152
154
163
167
157
175
165
169
150
22
181
166
179
191
171
173
189

189
187
185
183
197
195
166
201
205
203
150
209
199
197
213
22
166
211
215
255
265
201
221
223
245
261
225

219
201
261
225
166
245
217
263
166
201
245
225
231
233
235
261
245
237
235
239
241
247
243
249
251
253
261
294
292
300
296
290
292

METHOD OF OBTAINING IMPRESSION INFORMATION FROM A WELL

This is a division of application Ser. No. 510,265, filed Sept. 30, 1974.

CROSS REFERENCE TO RELATED APPLICATIONS

This application is related to the following applications: application Ser. No. 367,602 filed June 6, 1973, now U.S. Pat. No. 3,889,749; application Ser. No. 423,593 filed Dec. 10, 1973, now U.S Pat. No. 3,923,312; application Ser. No. 430,326 filed Jan. 2, 1974; application Ser. No. 373,341 filed June 25, 1973, now U.S. Pat. No. 3,855,854; application Ser. No. 373,342 filed June 25, 1973, now U.S. Pat. No. 3,855,855; application Ser. No. 373,343 filed June 25, 1973, now U.S. Pat. No. 3,855,856; concurrently filed application Ser. No. 510,260 for Hydraulically Actuated Wire Line Apparatus by Neal L. Mitchell, and application Ser. No. 510,264 for Gas Operated Hydraulically Actuated Wire Line Packer by Stanley O. Hutchison and Neal L. Mitchell. The contents of all eight of the above applications are hereby incorporated herein by reference.

FIELD OF THE INVENTION

The present invention relates to wire line inflatable packers which are run into a well on a wire line and which carry self-contained inflating fluid and operate automatically to inflate and deflate in the well on a predeterminable time schedule. More particularly, the present invention relates to a self-contained wire line run inflatable packer useful to carry an impression element on its outer surface for making an impression of a downwell surface, the inflatable packer being automatically sequentially inflated and deflated downwell by a valve controlled by a mechanically driven sequencing timer actuating means.

BACKGROUND OF THE INVENTION

In the operation of wells, it is often desirable to know the downhole condition of a well surface such as a well, or well casing. For example, it is important to know if the casing or the liner is cracked. Similarly, the extent of liner slot plugging and perforation size or absence is also useful information. This type of well information can be obtained by the use of impression packers. An impression packer is a device which is run down a well to a location from where information is desired and then an impression element is pressed against the well surface by suitable means, usually an inflatable packer, to take an impression of the well surface. The impression element is removed from the well surface usually by deflating the inflatable packer and then removed from the well for inspection.

The above cross-referenced applications relate in part to suitable impression elements and to suitable inflatable packers for use in running an impression element in a well. The inflatable packers described in the applications filed prior to the filing date of the present application, however, and those heretofore used in the prior art, have been run on a tubing string made of a number of tubing sections coupled together. The tubing string provides a conduit from the surface to the packer into which a fluid is injected down the well and into the packer to inflate it. The tubing string conduit is also used to deflate the packer. In the simplest form, this is done simply by releasing the pressure on the packer by venting the tubing string to atmosphere. In more sophisticated systems, the packer may be deflated by a downhole device which can be triggered by dropping a sinker bar or a similar weight from the surface down the tubing string. A drawback to the use of a tubing string for running inflatable packers, however, is the time and trouble of making up the tubing string from a plurality of tubing sections which must be successively coupled together at the surface as the tubing string is formed and lowered into the well. A well pulling rig is also needed to run and pull the tubing string.

In order to dispense with the use of the tubing string, it has been found desirable to develop an inflatable packer which can be run on wire line and which needs no operational connection such as a tubing string, or an electrical line to the surface. However, as noted when the inflatable packer is used to carry an impression sleeve into the well to obtain impressions therefrom, certain problems are encountered. Thus, the impression sleeve must be first lowered into the well to a depth where information is needed prior to inflating the packer to cause the impression sleeve to contact the well surface. Additionally, it is usually desirable to have the impression sleeve contact the well surface for a predeterminable time at a predeterminable pressure before deflating the packer and removing the packer carrying the impression sleeve from the well. In addition to these problems, a wire line inflatable packer must be entirely self-contained which necessitates carrying with the packer a source of high pressure gas for inflation use. The present invention is directed to solving these problems and thus providing an efficient and reliable wire line inflatable packer which is useful in making impression packer runs in wells.

BRIEF DESCRIPTION OF THE INVENTION

The present invention is directed to a wire line inflatable packer which is self-contained and which includes a sequencing timer actuating means for sequentially inflating and deflating the inflatable sleeve of the packer on a predetermined time schedule. The timer actuating means is initially activated on the surface and the packer is run into a well with the inflatable sleeve in a deflated condition. After passage of a predeterminable time, the sequencing timer actuating means acting on valve means within the packer operates to inflate the inflatable sleeve of the packer. The packer sleeve is maintained in such inflated condition for a predeterminable time and then the sequencing timer actuating means operates the valve means to deflate the inflatable sleeve of the packer and to thus put the packer in condition to be removed from the well. After the initial operation is initiated at the surface, the downhole sequencing of the packer is done automatically by means carried with the wire line run inflatable packer. The sequential downhole operation of the inflatable packer is particularly useful when an impression sleeve is used in obtaining an impression record of the well at a given depth.

In one aspect, the present invention is directed to an inflatable packer which has an elongated body which includes a tubing section. Means are provided for connecting a wire line to the upper end of the elongated body for running it into a well. An elongated inflatable resilient sleeve is positioned over at least a portion of the tubing section and the ends of the resilient sleeve are connected in fluid-tight relationship with the tubing section to form an annular chamber between the tubing section and the resilient sleeve. A port means provides a passageway for flowing fluid to and from the annular chamber. A gas source for storing high pressure gas is located in the elongated body of the packer and is used in inflating the resilient sleeve. A mechanically driven sequencing timer actuating means controls the inflation and deflation of the packer. A pressure sink is formed for use in deflating the resilient sleeve. Suitable conduits are connected between the gas source and the port means and between the port means and the pressure sink for use in inflating and deflating the sleeve. Valve means are connected to the conduits for selectively controlling flow of high pressure gas between the port means and the gas source through the conduits to inflate the resilient sleeve and between the port means and the pressure sink through the conduits to deflate the resilient sleeve. The sequencing timer actuating means is connected to the valve means for sequentially operating the valve means to first inflate the resilient sleeve after passage of a predeterminable time interval long enough to run the packer to the desired depth in a well and then to deflate the resilient sleeve after passage of a second predeterminable time interval to put the packer in condition for being pulled up the well. The timing sequence of the sequencing timer actuating means is determined by mechanically driven timer means.

The present invention includes sequencing timer actuating means of the wire line inflatable packer which is utilized to operate valve means to inflate and deflate the inflatable sleeve of the packer. The timing sequence of the sequencing timer actuating means is determined by a mechanically driven stem which activates valve means to control inflation and deflation of the packer. In preferred form, the valve means includes an elongated stem having means for sequentially opening and closing certain conduits to inflate and deflate the inflatable sleeve of the packer. The stem is connected to a mechanically driven clocklike device which causes the stem to move in the packer. As the stem moves, it sequentially opens and closes certain conduits to cause gas to flow to inflate and deflate the inflatable sleeve.

The source of high pressure gas is preferably contained within the tubing section which carries the inflatable sleeve. Suitable conduits are provided to arrange a flow path for the gas from this source to the annulus between the inflatable resilient sleeve and the outside of the tubing section. This flow path is controlled by the valve means. Suitable conduits connected through the valve means connect the annulus between the inflatable sleeve and the tubing member with a pressure sink for use in deflating the resilient sleeve. The pressure sink is usually a vent to the outside of the packer for exhausting fluids into the well.

The present invention provides a method of obtaining impression information from a well utilizing a wire line run self-contained inflatable packer. A wire line packer having an impression sleeve connected to the outside of an inflatable sleeve of the packer is run into a well. The packer is lowered down said well before the elapse of a predetermined time as determined by a mechanical timer means to position the impression sleeve at a predetermined depth in the well. The inflatable sleeve of said packer is inflated in response to the mechanical timer means to press the impression sleeve against the wall of the well. The inflatable sleeve is maintained in inflated condition for a predetermined time. Then, in response to the mechanical timer means, the inflatable sleeve of the packer is deflated and the impression sleeve is removed from the well. The packer is then removed from the well for inspection.

PRINCIPAL OBJECT OF THE INVENTION

The principal object of the present invention is to provide a self-contained wire line inflatable packer useful in obtaining impression records from wells which packer includes mechanically driven sequencing timer means for controlling the inflation and deflation of the resilient sleeve of the inflatable packer. Additional objects and advantages of the invention will become apparent from a detailed reading of the specification and drawings which are incorporated herein and made a part of this specification.

DETAILED DESCRIPTION OF THE PREFERRED EMBODIMENT

Figures 1, 2, 3, 4, 5:
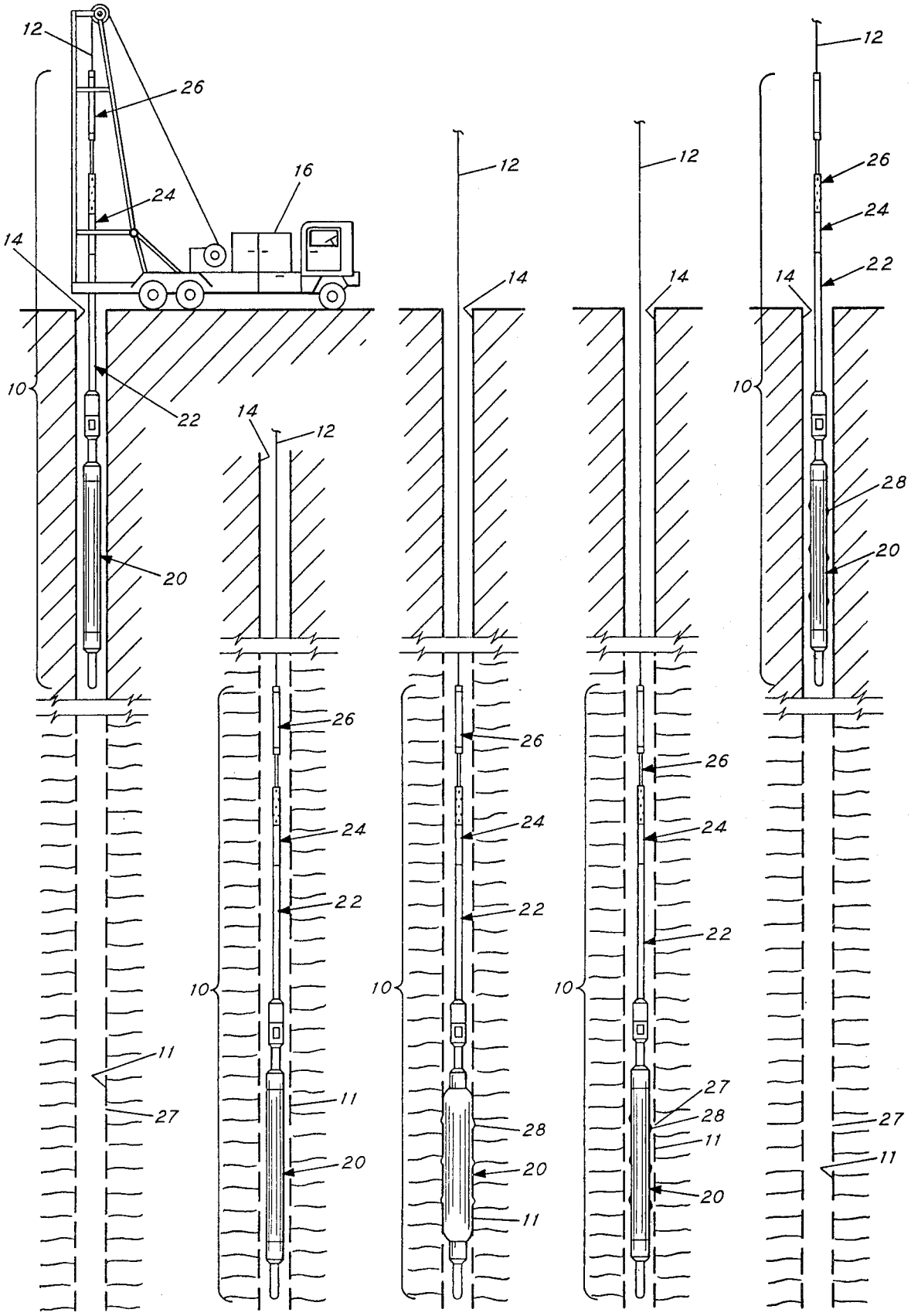
FIG. 1 through FIG. 5 inclusive are elevation views, partially in section, illustrating the preferred form of apparatus being run on wire line through a series of sequential operations performed in a well to obtain an impression record therefrom.
Figure 6:
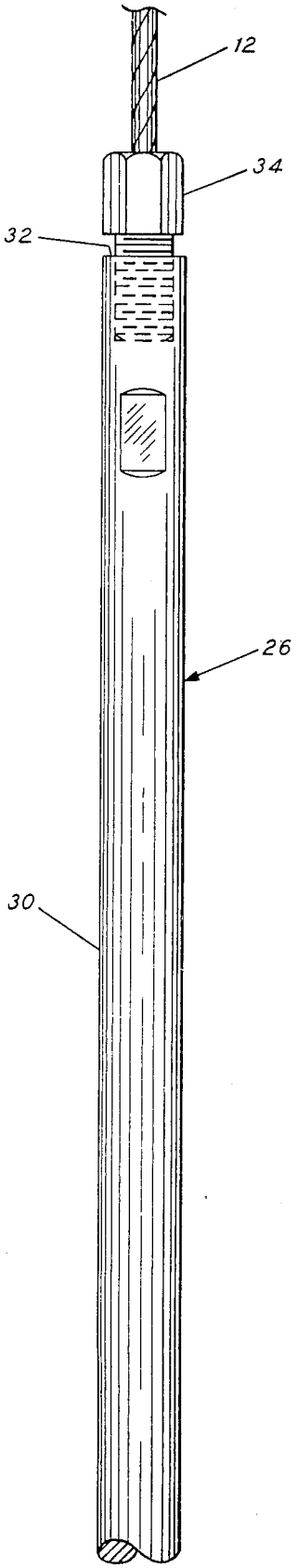
FIG. 6 through FIG. 16 inclusive are elevation views, partially in section, and illustrate the preferred embodiment of apparatus, sequentially from top to bottom, assembled in accordance with the present invention.
Figure 7:
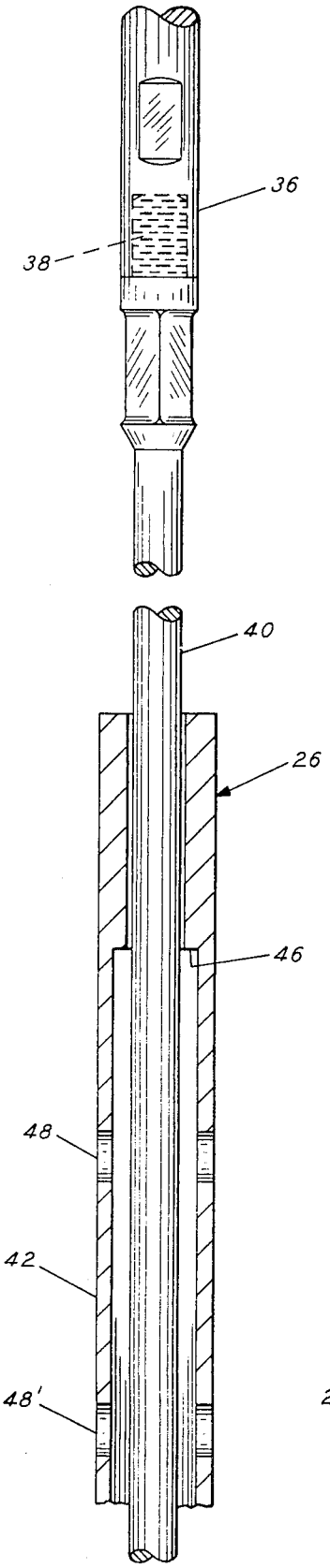
Figure 8:
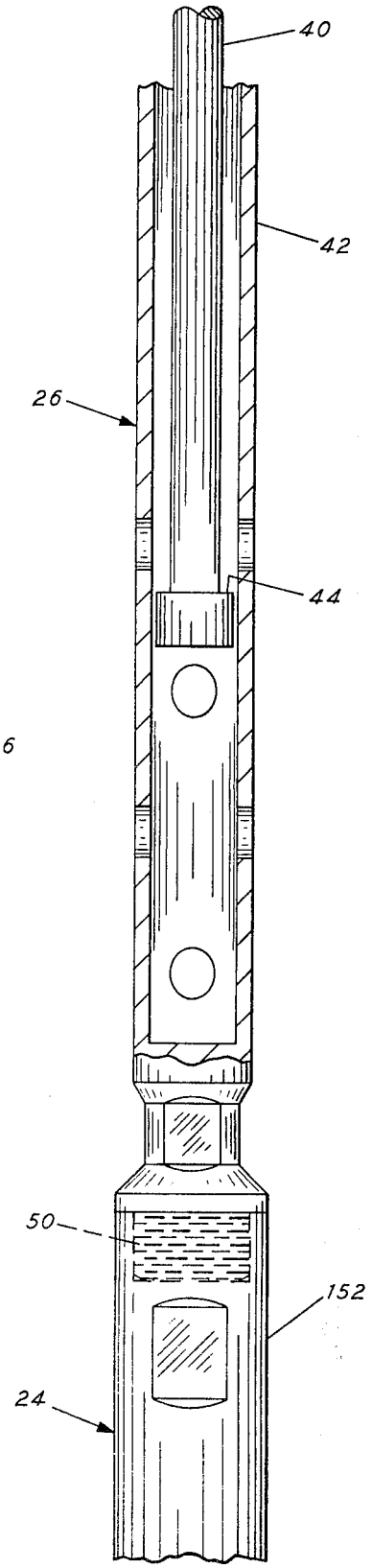

FIGS. 1 through 5 illustrate the preferred embodiment of apparatus of the present invention during an operational sequence in a well utilizing an outer impression sleeve to obtain information from the well. FIG. 1 shows the wire line inflatable packer, illustrated generally by the number 10, hung on wire line 12 in a well 14. A suitable hoist truck 16 is used to run the packer 10 in and out of the well. The inflatable packer 10 preferably includes a number a major subassemblies including an inflatable sleeve portion indicated generally as 20 and a control portion indicated generally as 22. The inflatable packer 10 may also include a pressure-temperature-subassembly indicated generally as 24 and a wire line jar subassembly indicated generally as 26.

The wire line inflatable packer 10 is lowered into the well on wire line to a position such as is shown in FIG. 2 from where it is desired to obtain an impression from the well wall. Prior to lowering the wire line inflatable packer 10 into the well, a sequencing timer actuating means contained within the control portion 22 of the inflatable apparatus 10 is activated to begin an automatic sequence of inflation and deflation of the inflatable sleeve of the packer. Thus, after elapse of predetermined time, which is of sufficient duration to permit positioning the wire line inflatable packer at the desired depth in the well, the timer actuating means initiates operation of the inflatable sleeve of the packer, and as shown in FIG 3, causes it to inflate and press the impression sleeve against the well liner 11. The impression sleeve on the outside of the inflatable sleeve of the packer is pressed into slots 27 or breaks in the well liner to form a lasting impression 28 on the impression sleeve. From the impressions on such a sleeve an accurate picture of the well liner condition can be formed. After a predetermined time has passed, the sequencing timer actuating means operates the valve means of the packer to deflate the inflatable sleeve as indicated in FIG. 4. The inflatable wire line packer 10 is then returned to the surface by the wire line 12 as shown in FIG. 5. The impression sleeve is inspected to give an accurate picture of the condition of the well liner 11.

The wire line inflatable packer is self-contained. The inflating fluid is carried within the packet 10. This is usually high pressure gas. In many applications, it is desirable to use a noncompressible liquid such as water in the annulus between the inflatable sleeve and the tubing section to act as a filler so that not so much high pressure gas is required to inflate the inflatable sleeve. The control portion of the wire line inflatable packer includes sequencing timer actuating means for use in operating a valve arrangement to sequentially inflate and deflate the inflatable sleeve of the packer on a predetermined time schedule. The timer actuating means is initially activated on the surface and the packer is run into a well with the inflatable sleeve in a deflated condition. After a predeterminable time has elapsed, the sequencing timer actuating means acts on valve means within the packer to cause inflation of the inflatable sleeve of the packer. The packer sleeve is maintained in such inflated condition for a predeterminable time and then the sequencing timer actuating means operates the valve means to deflate the inflatable sleeve of the packer and to thus put the packer in condition to be removed from the well. After the sequencing timer actuating means is started at the surface, the downhole sequencing of the packer is done automatically by means carried with the wire line run inflatable packer. The sequential downhole operation of the inflatable packer is particularly useful when an impression sleeve is used in obtaining an impression record of the well at a given depth.

The preferred form of the inflatable wire line packer 10 is shown in detail in FIG. 6 through 16. These figures illustrate the packer sequentially from the top down beginning where wire line 12 is connected into the upper portion of the packer 10. The wire line jar subassembly 26 includes one or more sinker bars 30 to weight the apparatus for wire line jarring it loose if necessary. The upper portion 32 of the sinker bar 30 is taped with threads for receiving a pin end 34 of the wire line 12. The lower end 36 of the sinker bar 30 mates with the upper end 38 of a jar rod 40. The jar rod 40 is slidably received into a tubular sleeve member 42 and is retained therein by means of flange 44 contacting shoulder 46. A series of holes 48, 48' permit fluid flow into and out of the interior of sleeve member 42. The lower end 50 of sleeve member 42 is threadably connected to the upper portion of a pressure-temperature-subassembly 24. The wire line jar subassembly thus often permits freeing the wire line packer if it becomes stuck in the well by reciprocating the wire line 12 to cause the jar rod 40 to hit against the sleeve member 42.

The pressure-temperature-subassembly 24 is used when it is desired to record pressure-temperature data during the operation. There are many conventional pressure-temperature subassemblies adapted for use in accordance with the invention. Therefore, a specific description of the pressure-temperature subassembly is not given here. One such conventional pressure-temperature subassembly useful in accordance with the present invention is known as product KPG AMERADA TYPE manufactured by the Kuster Company.

The control portion 22 and the packer sleeve portion 20 of the wire line inflatable packer 10 of the present invention provides a self-contained automatic inflatable packer for running on wire line and it is useful in obtaining impression information from a downhole location in a well. In one aspect, inflatable packer 10 has an elongated body which includes a tubing section. Means are provided for connecting a wire line to the upper end of the elongated body for running the inflatable packer into a well. An elongated inflatable resilient sleeve is positioned over at least a portion of the tubing section and the ends of the resilient sleeve are connected in fluid-tight relationship with the tubing section to form an annular chamber between the tubing section and the resilient sleeve. A port means provides a passageway for flowing fluid to and from the annular chamber. A gas source for storing high pressure gas is located in the elongated body of the packer and is used in inflating the resilient sleeve.

A pressure sink is formed for use in deflating the resilient sleeve. The pressure sink may be the outside of the packer which in operation is the well itself. Suitable conduits are connected between the gas source and the port means and betweeen the port means and the pressure sink for use in inflating and deflating the sleeve. Valve means are connected to the conduits for selectively controlling flow of high pressure gas between the port means and the gas source through the conduits to inflate the resilient sleeve and between the port means and the pressure sink through the conduits to deflate the resilient sleeve. The sequencing timer actuating means is connected to the valve means for sequentially operating the valve means to first inflate the resilient sleeve after passage of a predeterminable time interval long enough to run the packer to the desired depth in a well and then to deflate the resilient sleeve after passage of a second predeterminable time interval to put the packer in condition for being pulled up the well. The timing sequence of the sequencing timer actuating means is determined by a mechanically driven timer means.

The sequencing timer actuating means of the wire line inflatable packer is utilized to operate the valve means to inflate and deflate the inflatable sleeve of the packer. In preferred form, the valve means includes an elongated stem connected to the sequencing timer actuating means and has means for sequentially opening and closing certain conduits to inflate and deflate the inflatable sleeve of the packer. The stem is connected to the sequencing timer actuating means and is caused to move thereby. The speed of the drive motor and the geometry of the valve means can be varied to vary the time sequence of inflation and deflation of the packer sleeve. These variables can be adjusted to give a desired time sequence for a given operation.

The source of high pressure gas is preferably contained within the tubing section which carries the inflatable sleeve. Suitable conduits are provided to arrange a flow path for the gas from this source to the annulus between the inflatable resilient sleeve and the outside of the tubing section. This flow path is controlled by the valve means. Suitable conduits connected through the valve means connect the annulus between the inflatable sleeve and the tubing member with a pressure sink for use in deflating the resilient sleeve. The pressure sink is usually a vent to the outside of the packer for exhausting fluids into the well.

Figures 9, 10, 11:
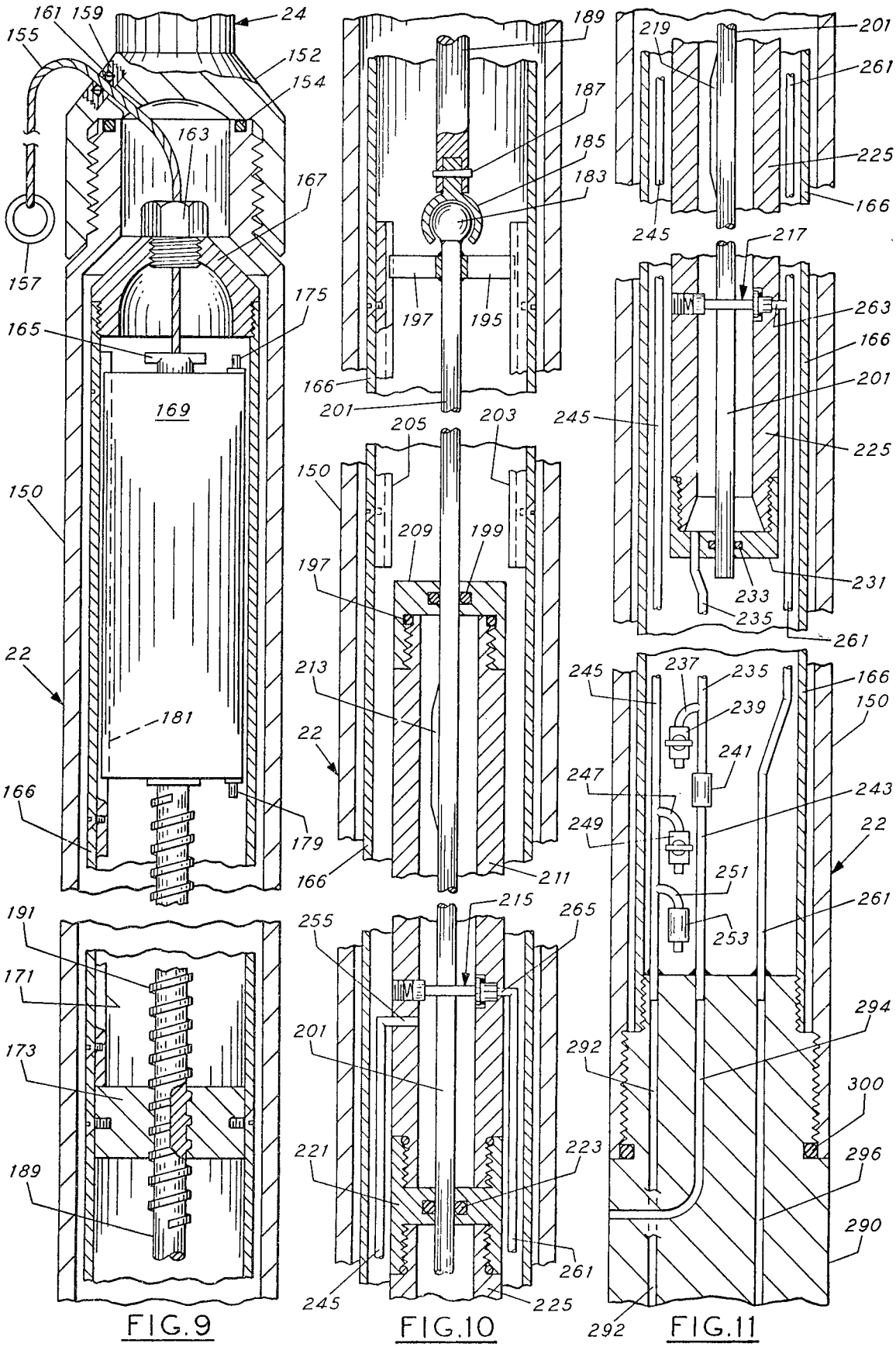
Figure 12:
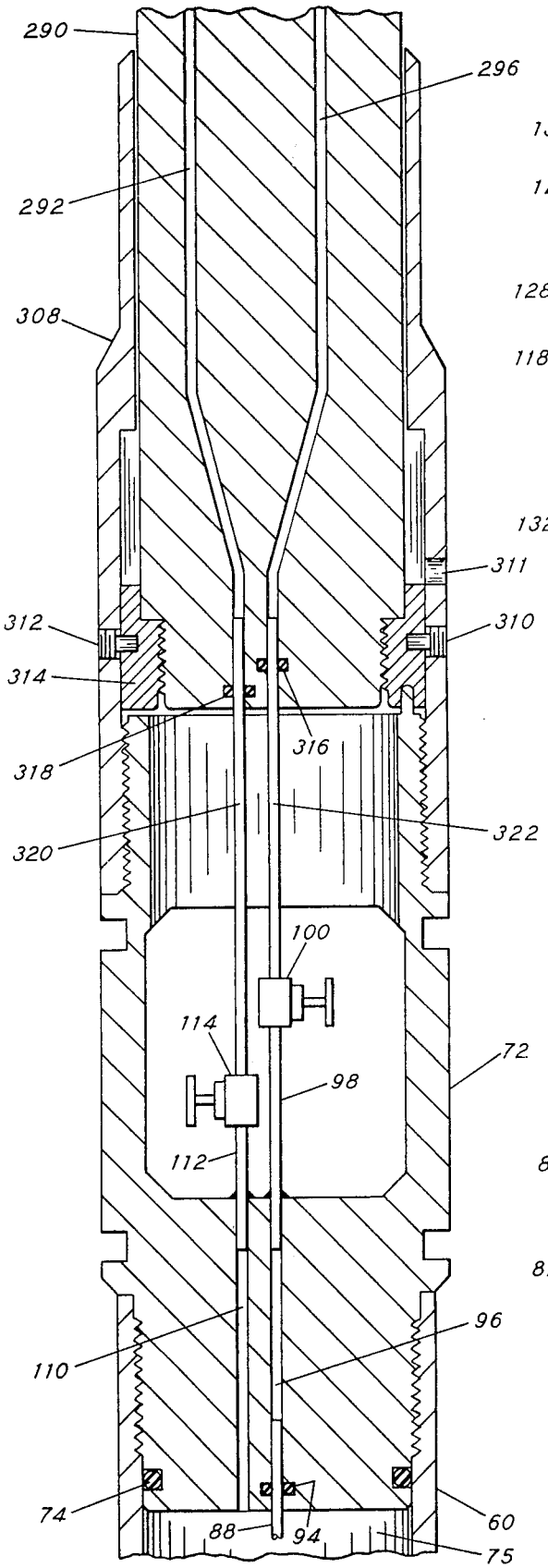
Figure 13:
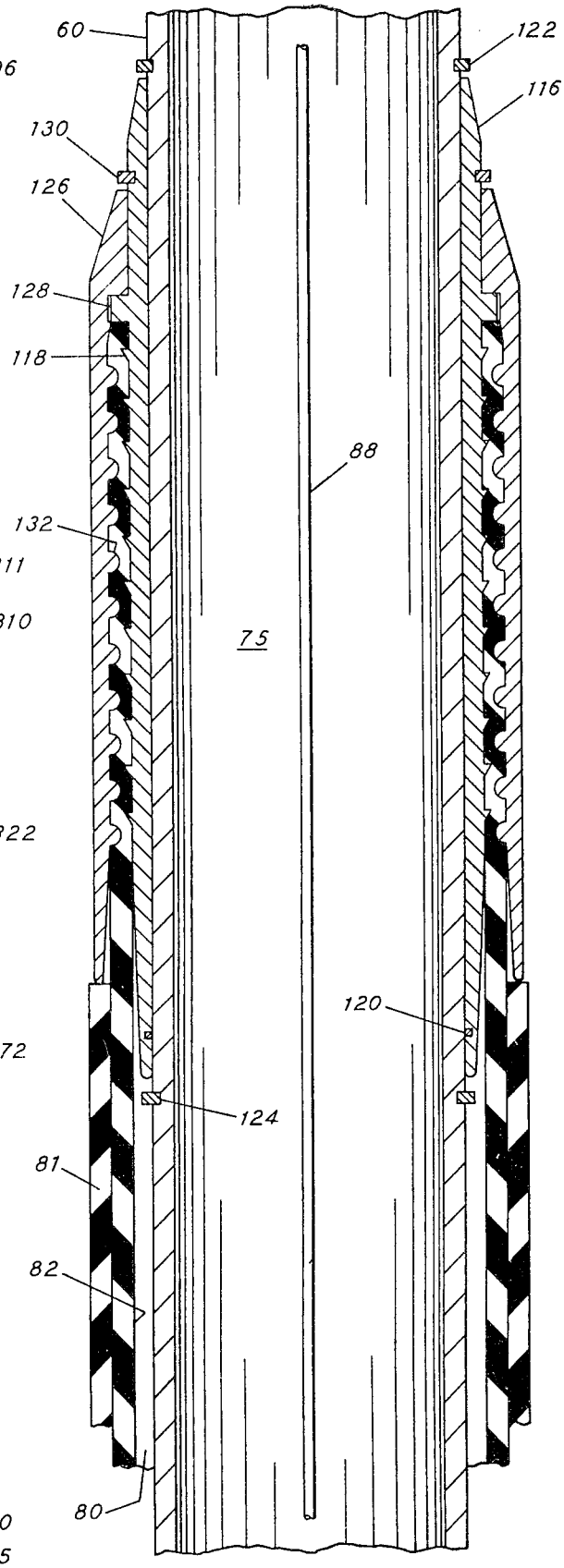
Figure 14:
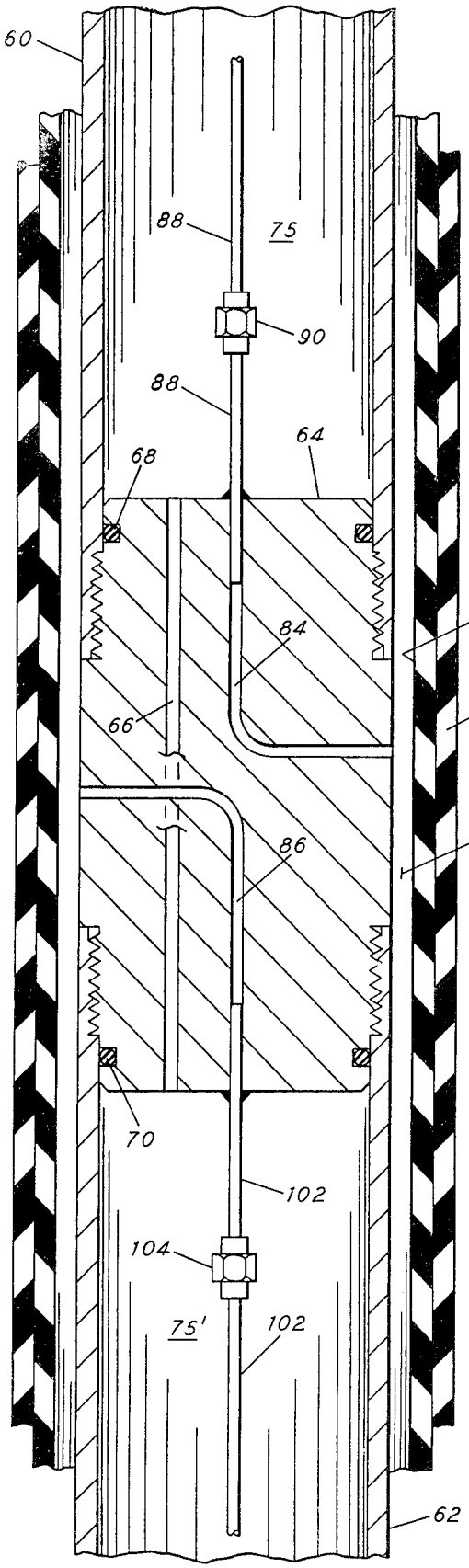
Figure 15:
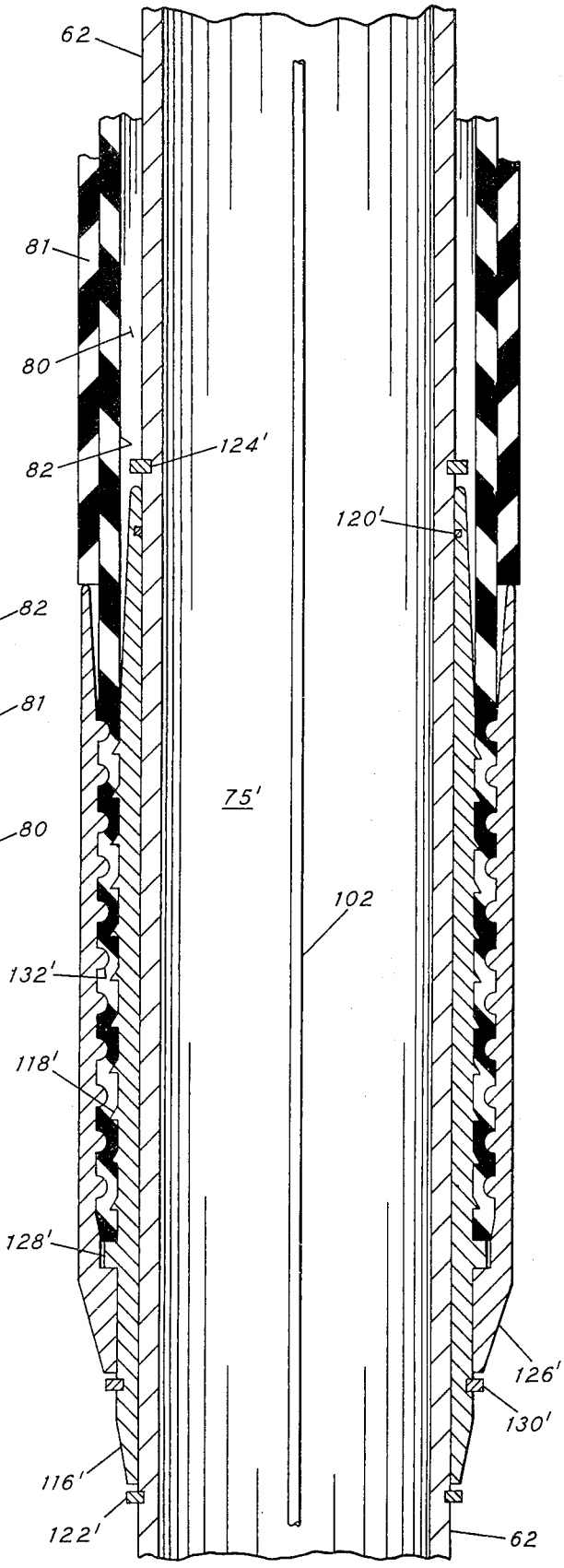
Figure 16:
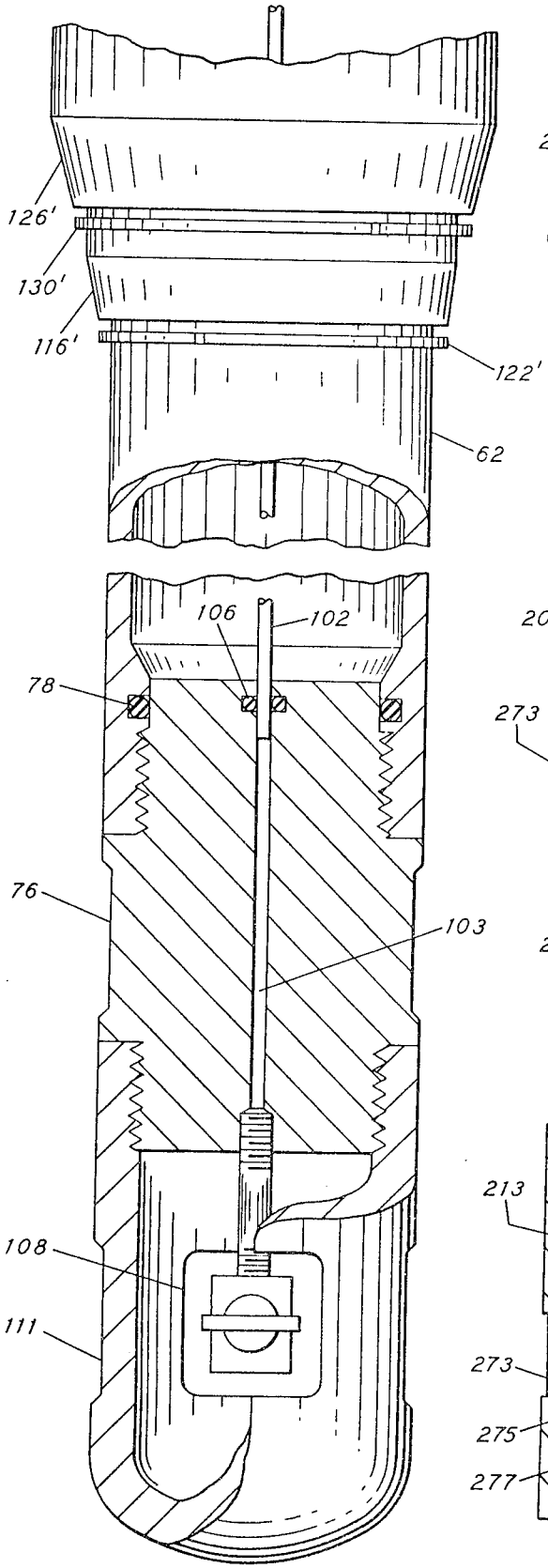

The control portion 22 and the inflatable sleeve portion 20 will now be described in detail with respect to FIGS. 9 through 16. In order to facilitate this description, the inflatable sleeve portion 20 which is shown in the lower portion of FIG. 12 to FIG. 16 will be described before describing the control portion 22 which is shown in FIG. 9 to the upper portion of FIG. 12. The inflatable sleeve portion 20 includes a resilient sleeve positioned on an inner tubing section. The resilient sleeve is expanded by injecting fluid into the annulus between the tubing section and the interior of the resilient sleeve. The inside of the tubing section serves as a container for a pressurized gas useful to inflate the resilient sleeve.

An elongated inner tubing section is formed in the preferred embodiment by an upper tubular member 60 and a lower tubular member 62 connected together by a packer crossover sub 64. The crossover sub 64 has a conduit 66 connecting the interiors 75, 75' of the tubular members 60, 62. Fluid-tight joints are provided between the tubular members 60, 62 and the crossover sub 64 by means of O-rings 68, 70. A disconnecting sub 72 seals off the upper portion (except for passageways 110 and 96 as later described) of the upper tubular member 60 utilizing O-ring 74. A bottom plug 76 seals off the lower portion (except for passageway 104 as later described) of the lower tubular member 62 utilizing O-ring 78. Thus, a fluid-tight chamber is formed inside the tubing section of the packer and this chamber is used to contain high pressure fluid such as nitrogen gas which is used as the energy fluid to inflate the resilient sleeve.

It has been found that the volume of gas needed to inflate the resilient sleeve can be greatly reduced by filling most of the volume to be filled with a noncompressible liquid such as water. Therefore, the preferred embodiment is arranged to facilitate loading the annular space 80 between the outside of the tubing section formed by tubular members 60, 62 and the inside of the inflatable sleeve 82 with a noncompressible liquid such as water. Thus, crossover sub 64 is provided with an upper passageway 84 communicating with the annular space 80 and a lower passageway 86 also communicating with the annular space 80. A conduit 88 having a connector 90 is connected into passageway 84 and extends through O-ring 94 into passageway 96 in the disconnecting sub 72. An extension conduit 98 having a valve 100 extends out of passageway 96 to provide communciation from outside of the packer portion to the annular chamber 80. A conduit 102 having a connector 104 is connected into passageway 86 of crossover sub 64. Tubing section 102 extends into passageway 103 through plug sub 76 and is sealed therein by an O-ring 106. A control valve 108 located in a bull plug 111 for protection is connected to passageway 103 to control flow therethrough. Thus, the annular space 80 may be loaded with water when the packer is horizontal by injecting water into one side of the chamber while bleeding air off from the other. After the annular space 80 and the conduits are so filled, the valves 100 and 108 are closed to retain the water until the wire line apparatus is ready to run.

An outlet passageway 110 is formed in the disconnecting sub 72 to provide an outlet for high pressure fluid contained in the fluid-tight chamber 75, 66, 75' formed inside the tubing section of the inflatable sleeve portion of the packer. A fluid-tight conduit 112 having a control valve 114 is connected in passageway 110. Thus, a source of high pressure fluid is provided within the inflatable sleeve portion of the packer to supply energy for the wire line packer.

The inflatable resilient sleeve 82 is connected at its upper and lower ends in fluid-tight relationship to the tubing section which is formed by the upper tubular member 60 and the lower tubular member 62. The upper and lower clamping means are usually similar in construction. In this description, as well as in other portions of this specification, the same numbers with prime notations are used to indicate similar parts used to indicate the different parts of the apparatus. The clamping means includes an inner sleeve 116, 116' which fits in sliding relationship over the tubular members 60, 62. The outside surface of the inner sleeve 116, 116' has a number of annularly extending serrations 118, 118'. An O-ring 120, 120' is located between the inside of the inner sleeve 116, 116' and the outside of the tubular member 60, 62 to provide a fluid-tight seal between the tubular member 60, 62 and the inner sleeve 116, 116'. Retaining rings 122, 122' and 124, 124' are connected in grooves on the exterior of the tubular members 60, 62 above and below the inner sleeve 116, 116' to limit the movement of the inner sleeve and thus the clamping means on the tubular members 60, 62. The retaining rings 122, 122' and 124, 124' can be removed and repositioned in other grooves conveniently located on the exterior of the tubular members 60, 62. Thus, if the flexible resilient sleeve 82 must be shortened during field repair, the retaining rings are removed and the clamping means are moved to a new position on the tubular members and reconnected. A force fit outer sleeve 126, 126' cooperates with the innersleeve 116, 116' to hold the end of the resilient sleeve 82. The resilient sleeve 82 is positioned against a flange 128, 128' formed on the upper portion of the exterior of the inner sleeve 116, 116'. A retaining ring 130, 130' is fitted into a groove on the outside of the inner sleeve to prevent movement of the outer sleeve 126, 126' after connection has been made. The interior of outer sleeve 126, 126' is provided with annular protruberances 132, 132' which cooperate with the serrated portion 118, 118' of the inner sleeve 116, 116' to grip the end of the resilient sleeve 82 to hold the sleeve 82 in fluid-tight relationship with the mandril 60, 62. An impression sleeve 81 is connected to the outside of the inflatable resilient sleeve 82 for use in making an impression of a well conduit as described above.

The inflatable sleeve portion 20 of the packer thus includes a chamber 75, 75' for storage of gas useful to inflate the inflatable element 82. In preferred form, this chamber is loaded with nitrogen at suitable pressure for inflating the packer, usually in excess of 100 psi. Valves 114 and 100 control flow, respectively, out of the high pressure chambers 75, 75' and into the annulus 80 formed by inflatable element 82 and the outside of the tubing section formed by the upper tubular member 60 and the lower tubular member 62. The gas from the fluid-tight chamber 75, 75' may be flowed through conduit 112, valve 114, conduit 320 and passageway 292 into the valve portion of the packer. A suitable O-ring 318 seals conduit 320 into passageway 292 in control sub 290. An O-ring 316 also seals conduit 322 into passageway 296 of the control sub 290. Control sub 290 is connected to the disconnecting sub 72 by a shearable means so that if the inflatable sleeve portion 20 becomes stuck in a well, the upper portion of the wire line packer may be pulled free and removed from the hole. After shearing pins 310 and 312 sub 290 moves up a sufficient distance so that passageways 320 and 322 clear O-rings 318 and 316 respectively. The high pressure gas in chamber 75, 66 and 75' and the gas and water in the annulus 80 can then escape through port 311. A fishing sleeve 308 is threadably connected to disconnecting sub 72 and an inner annular sleeve 314 is threadably connected to control sub 290. Shear pins 310, 312 connect the sleeves 308, 314 together for normal operation.

The control portion 22 of the inflatable wire line packer 10 will now be described with reference to FIGS. 11 through 9. The control portion includes the sequencing timer actuating means and the valve means which control flow through conduits to inflate and deflate the packer which is assembled in accordance with the present invention. The elongated body above the tubing section is now continued by outer tubular member 150. The upper end of the outer tubular member 150 is connected to the lower end 152 of the wire line jar subassembly 24 by threaded connections containing a suitable O-ring 154. The lower end of the outer tubular member 150 is threadably connected to the control sub 290 and sealed by an O-ring 300. An inner shell 166 supports the valve means and sequencing timer actuating means of the wire line inflatable packer. Cap member 163 allows access to the interior of the shell member 166.

Conduit 245 is connected in fluid-tight relationship into passageway 292 and provides a passageway for high pressure gas to port 255. A branch conduit 251 containing check valve 253 is provided for loading high pressure gas into the chamber 75, 75' of the tubing section. A second branch conduit 247 containing control valve 249 is provided for draining gas from the system if desired. The inflating gas in conduit 245 will ultimately be used to inflate the inflatable sleeve of the wire line packer.

The inflating gas is directed through port 255 into the interior of tubular member 211. The upper end of tubular member 211 is sealed in a fluid-tight manner by means of a cap 209, O-ring 197, and O-ring 199, which engages elongated stem 201. The lower end of the tubular member 211 is also sealed in a fluid-tight manner by crossover 221 and O-ring 223 which engages elongated stem 201. A poppet valve indicated generally by the numeral 215 controls flow out of tubular member 211 through port 265 to conduit 261. When valve 215 is opened and poppet valve 217 is closed, inflating gas will flow through conduit 261, passageway 296, conduit 322, valve 100, conduit 98, passageway 96, conduit 88, connector 90, and passageway 84 to the annular space 80 to inflate resilient sleeve 82.

Tubular member 225 is located below tubular member 211 and is connected thereto by crossover 221. The upper end of the tubular member 225 is fluid-tight by virtue of O-ring 223 sealing against elongated stem 201. A cap member 231 containing O-ring 233 which engages the stem 201 provides a fluid-tight seal for the other end of tubular member 225 except for conduit 235 which leads to the pressure sink. A poppet valve 217 controls flow into the interior of tubular member 225. Thus, when poppet valve 217 is opened and poppet valve 215 is closed, gas and/or water flow from the annular space 80 behind resilient sleeve 82 via passageway 84, conduit 88 through connector 90, passageway 96, conduit 98, valve 100, conduit 322, passageway 296, conduit 261, and conduit 263. After entering the interior of tubular member 225, the gas and/or water which is coming from deflating the resilient sleeve 82 will flow to the pressure sink outside of the packer via conduit 235, check valve 241, conduit 243, and passageway 294. A branch conduit 237 having manual control valve 239 is provided for manual operation if necessary.

The poppet valves 215 and 217 are operated in response to movement of elongated stem 201 which brings one of the cams 213 or 219 formed thereon into engagement with the corresponding poppet valve. The geometry of the stem 201, the poppet valves 215, 217 and the cams 213, 219 is such that a predetermined time elapses before cam 213 engages valve 215 to inflate the inflatable resilient sleeve of the packer. The cam 213 is a sufficient length to hold the valve 215 open at least long enough to obtain the desired inflation. During this period, an impression can be formed on the impression sleeve 81 of the packer. After a predetermined time, cam 213 passes through valve 215 to clear the valve. Later, cam 219 then opens valve 215 to deflate the resilient sleeve to ready the packer for removal from the well.

Figure 19:
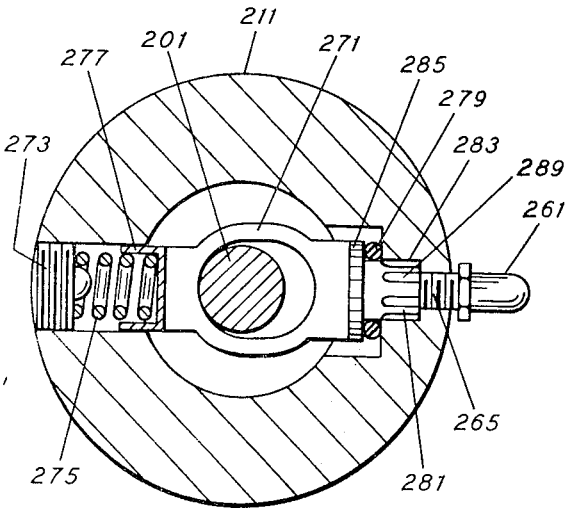
FIG. 19 is a sectional view of a closed valve assembled in accordance with the invention.
Figure 18:
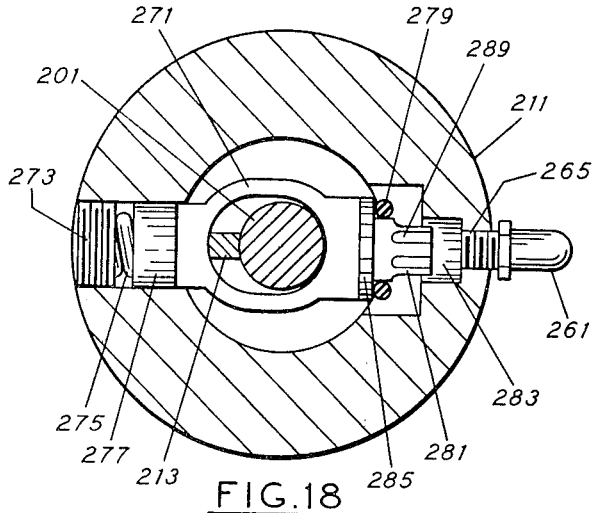
FIG. 18 is a sectional view of an open valve assembled in accordance with the invention.
Figure 17:
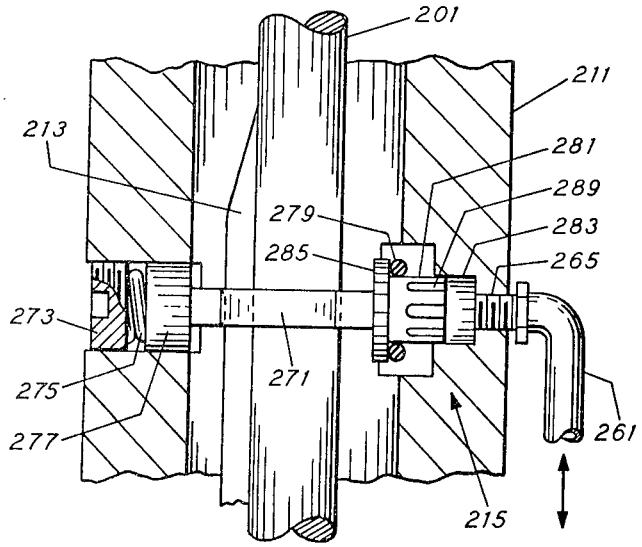
FIG. 17 is a partial sectional elevation view of a valve assembled in accordance with the invention.

Referring briefly to FIGS 17 – 19, a suitable poppet valve is illustrated. Thus, a valve stem 281 containing O-ring 279 on plate 285 moves in and out of valve seat 283 in tubular member 211 to control flow in port 265 and conduit 261. The serrated portion 289 of the valve insures full flow when the valve is opened. A spring 275 is urged by bolt 273 into a recess 277 in the valve body 271 to normally close the valve. A central opening in the valve body 271 receives elongated stem 201 when the valve is closed (FIG. 19). The valve is opened when the cam 213 moves into the central opening (FIG. 18).

Thus, the control valves are activated by movement of the elongated stem 201. The elongated stem is moved downwardly during an operational sequence by the sequencing timer actuating means across the various valves to inflate and deflate the inflatable sleeve of this embodiment of the wire line packer. The elongated stem 201 is connected to a shaft 189 by a rotatable ball and socket type joint 183, 185, 187. The elongated stem 201 is restrained from rotating as it moves up or down by means of track members 203 and 205 which engages guide arms 195 and 197 extending from the elongated stem 201. In this manner, cams 213 and 219 of stem 201 are kept in line with the openings in valves 215 and 217.

A drive motor 169 is provided with springs or other suitable devices such as electric or pneumatic powered motor to rotate shaft 189. The shaft 189 is provided with an exterior worm gear 191. A mating gear is contained in insert 173 so that as shaft 189 rotates, it will move with respect to the fixed insert 173. This down or up movement is translated to the elongated stem 201 for operating the valve means. A track 171 is engaged by a groove 181 on the side of the drive motor to prevent the motor from rotating.

The drive motor is illustrated in FIG. 9 in position to initiate a sequenced operation. Operation is initiated by pulling cord 155, 157, which extends through insert 159, O-ring 161 and cap 163 and which activates switch 165 to start the drive motor 169. Cap 163 positioned in member 167 may be removed to service th motor. The switch is a two-way switch and the direction of rotation of the shaft can be reversed to return the motor to start position after an operating sequence. Limit cutoff switches 175, 179 stop the drive motor 169 at the end of an operation sequence or a reposition operation.

Although certain specific embodiments of the invention have been described herein in detail, the invention is not to be limited to only such embodiments, but rather only by the appended claims.

I claim:

1. The method of obtaining impression information from a well comprising activating at the earth's surface a sequencing timer means contained in a wire line packer for inflating and deflating said packer, running into a well said wire line packer having an impression sleeve connected to the outside of an inflatable sleeve of said packer, lowering said inflatable packer down said well before the elapse of a predetermined time to position the impression sleeve at a predetermined depth in said well, automatically inflating said inflatable sleeve of said packer in response to said sequencing timer means to press said impression sleeve against the wall of said well, maintaining said inflatable sleeve in inflated condition for a predetermined time, then automatically deflating the inflatable sleeve of said packer in response to said sequencing timer means to remove said impression sleeve from said well wall, and removing said inflatable packer from said well.

* * * * *